United States Patent [19]

Gerry

[11] Patent Number: 4,590,536

[45] Date of Patent: May 20, 1986

[54] RESISTIVE-CAPACITIVE IGNITER AND CABLE

[76] Inventor: Martin E. Gerry, 13452 Winthrope St., Santa Ana, Calif. 92705

[21] Appl. No.: 747,039

[22] Filed: Jun. 20, 1985

[51] Int. Cl.[4] ..... H01T 13/05

[52] U.S. Cl. ..... 361/253; 123/633; 174/32; 174/36; 333/12

[58] Field of Search ..... 123/169 EL, 633; 313/134; 361/253; 333/12, 24 C, 140; 315/85; 174/36, 126 R, 32; 343/851

[56] References Cited

U.S. PATENT DOCUMENTS

| | | | |
|---|---|---|---|
| 3,965,879 | 6/1976 | Fitzner | 313/134 |
| 4,078,534 | 3/1978 | Mayer | 313/134 |
| 4,413,304 | 11/1983 | Gerry | 343/851 |
| 4,422,054 | 12/1983 | Gerry | 333/24 C |
| 4,451,764 | 5/1984 | Gerry | 123/633 |

*Primary Examiner*—L. T. Hix
*Assistant Examiner*—David M. Gray

[57] ABSTRACT

A transmission cable (30, 50) for an ignition system of a fuel burning engine has a body of electrical insulation (31, 51). The cable has embedded in its insulation either a distributed or lumped parameter capacitive element (32–34, 52–53) connected in parallel with either a distributed or lumped parameter resistive element (36, 56) which coact to increase the energy delivered to an igniter and hence to a fuel nodule. An igniter for such fuel burning engine has an electrical insulator (20, 520) and an electrode structure (130, 330, 530). The igniter may have a ceramic magnet insulator which accelerates the arc plasma and raises the arc's energy level. Arc transfer members (137–138, 537–538, 537′–538′) are partially embedded in the insulator enabling long arcs to be supported. Configurations of the igniter include a capacitor (132–133, 332–333, 532) in parallel with a resistor (134, 334, 533), wherein the parameter values of the capacitor and resistor are such as to produce first order poles with only real parts in the complex plane defining the ignition current.

24 Claims, 11 Drawing Figures

FIG. 8
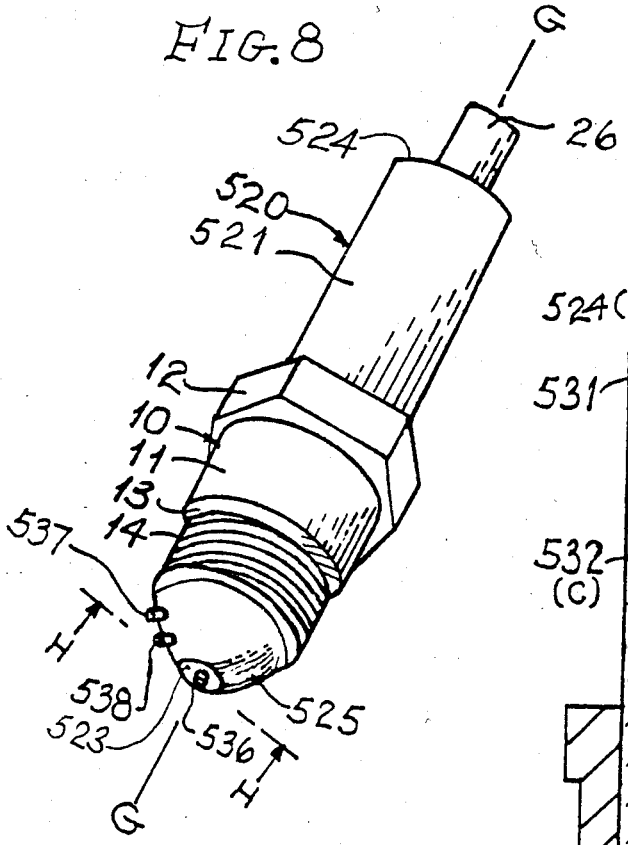
FIG. 9
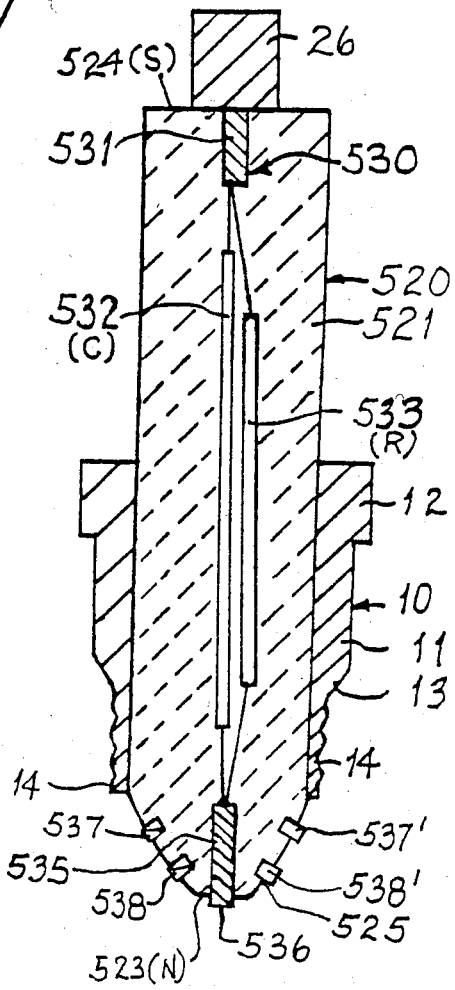
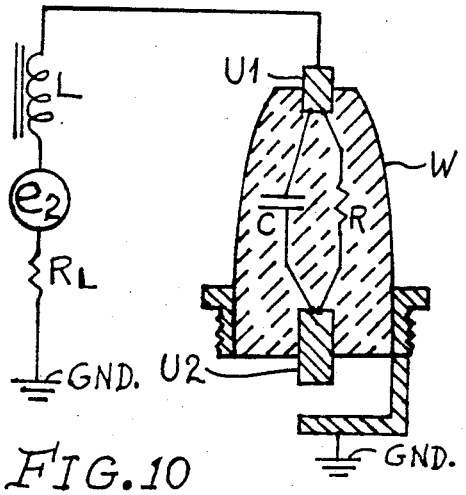
FIG. 10
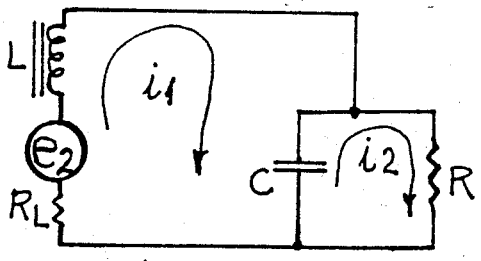
FIG. 11

RESISTIVE-CAPACITIVE IGNITER AND CABLE

CROSS REFERENCE TO RELATED PATENT APPLICATION

This application is related to U.S. patent application Ser. No. 647,166 filed Sept. 4, 1984 to same applicant. Since the theory of this application is identical to Application Ser. No. 647,166, such application Ser. No. 647,166 is incorporated by reference herein.

TECHNICAL FIELD

This invention is in the field of high voltage ignition cables and distributed parameter ignition components for a fuel burning engine.

BACKGROUND ART

There is no known background art emobodying the capacitive and resistive parallel parameter characteristics of a high voltage ignition cable and distributed parameter ignition components.

U.S. Pat. Nos. 4,451,764, 4,422,054 and 4,413,304 to same applicant feature distributed capacitive parameter cables without resistive parallel components.

DISCLOSURE OF INVENTION

It is an objective of this invention to provide a transmission cable for transferring high transient currents fed by an ignition transformer secondary winding to an igniter without producing destructively high voltages in the cable.

It is another objective of this invention to provide high ignition currents and relatively low voltage drops across the cable, wherein the cable would have such properties that cause cancellation of radiated electric and magnetic fields so as to minimize radio noise.

It is still another objective of this invention to increase the energy level fed by an igniter to a fuel charge within a combustion chamber of a fuel burning engine.

Accordingly, a high voltage ignition transmission cable is provided with resistive and capacitive parameters in parallel. Such capacitive parameters are either distributed or lumped, and such resistive parameters are also either distributed or lumped. When the resistive parameters are distributed, a relatively thin and high resistance wire, a fiber saturated with carbon or the like, or the electrical insulation in which the capacitor is embedded is itself resistive or semi-conductive, may be used. When a lumped parameter resistor and capacitor is used, such may be situated anywhere along the cable length. Structures similar to the distributed or lumped parameter resistor-capacitor may be embedded within an igniter's insulator as part of the center electrode, with the same benefits as obtained for the cable. These parallel distributed parameter structures maintain high ignition current conduction but minimize electric and magnetic field radiation and provide high energy by the igniter, while diminishing radio noise.

BRIEF DESCRIPTION OF DRAWINGS

FIG. 8 is a perspective view of an igniter with a generally hemispherical firing end, the main electrode at such firing end is aligned with axis G—G of the igniter.

FIG. 9 is a cross section view taken at plane H—H of FIG. 8 to show the capacitive-resistive combination as an integral part of the main electrode structure.

FIG. 10 is an electro-structural schematic of an igniter connected to a secondary winding of an ignition transformer having an induced voltage therein, to illustrate potentials at several locations of the igniter.

FIG. 11 is an equivalent circuit of the secondary winding of an ignition transformer with its induced voltage providing ignition current through the R-C components of the igniter illustrated in FIG. 10. The same equivalent circuit was the basis for the performance computations of the R-C components of various cable models as computed in Application Ser. No. 647,166 incorporated by reference, and such computations would be identical for the igniters herein.

BEST MODE FOR CARRYING OUT THE INVENTION

Figure 1:
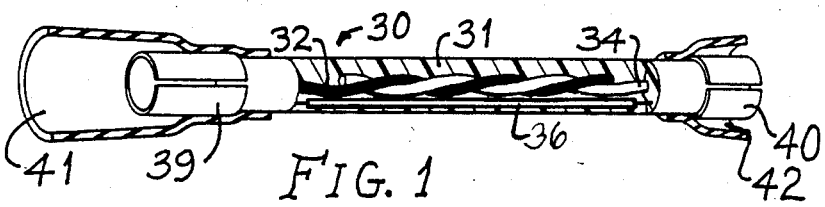
FIG. 1 is a perspective view, partially in cross section, of the ignition cable in accordance with the invention.
Figure 2:
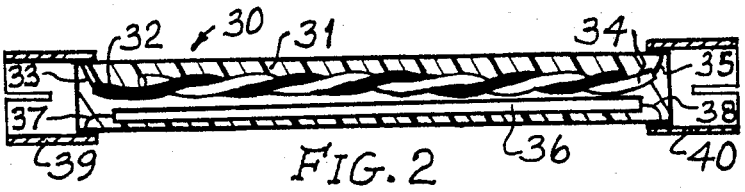
FIG. 2 is a cross section view along the length of the cable of FIG. 1, but without the end rubber retainer boots thereon.
Figure 3:
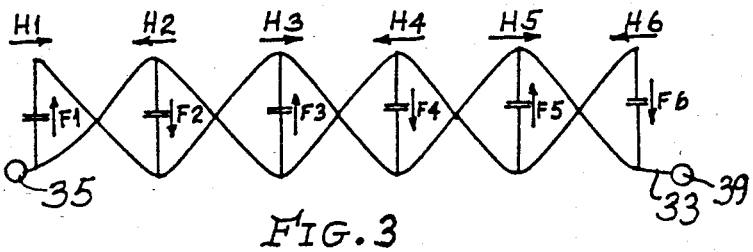
FIG. 3 is an electric and magnetic field schematic of the field components contributed by FIGS. 1 and 2 structure to show cancellation of radiated fields.

Referring to FIGS. 1, 2 and 3, one form of distributed parameter cable is shown at 30. Cable 30 takes advantage of the principle of distributed capacity between a pair of twisted or transposed wires in segmentary portions, effecting ignition current conduction through the distributed capacities inherent in cable 30.

A conventional electrical insulation body 31 has twisted pair of wires embedded therein. For ease of understanding, one wire is shown with a black color electrical insulation 32 encasing wire 33 which extends from and is bent over one end of insulation 31 for making electrical connection with connector 39 crimped to the outer surface of insulation 31. Another wire shown with a white insulation 34 encasing wire 35 which extends from and is bent over the other end of insulation 31 for making electrical connection with connector 40 is crimped by connector 40 on to the outer surface of insulation 31. Opposite ends of wires in black and white insulation which are opposite their ends connected to connectors 39 and 40, are within their respective black and white casings and are not connected to anything. Thus the twisted pair of wires acts as a capacitor, symbolically shown in FIG. 10 as capacitor C. Additionally, resistor 36 also embedded in insulation 31 is connected at one of its ends 37 to connector 39 being crimped between the connector and the outer surface of insulation 31. Resistor 36 is connected at its other end 38 to connector 40 being crimped between the connector and the outer surface of insulation 31. Thus, resistor 36, symbolically shown in FIG. 10 as resistor R, is electrically in parallel with the distributed capacitor. Cable 30 is shown in FIG. 1 with conventional rubber boots 41 and 42 at its ends for retaining the cable securely within ports of ignition system components to which such cable is connected.

It should be noted that resistor 36 may constitute a distributed parameter resistor of very thin strand, a lumped parameter resistor or a distributed parameter resistor made of a fiber saturated or coated with resistance material or the like.

The electrical equivalent circuit of cable 30 is shown in terms of FIG. 3, showing wires 33 and 35 and their respective terminations at connectors 39 and 40, wherein the wires have a number of transposed segments. Each of the segments of the wire pair is illustratively expanded so that the electro-magnetic field components can be ascertained and illustrated.

Assuming at one instant of time that termination at 40 of wire 35 is at a positive potential and the termination at 39 of wire 33 is at a negative potential with respect to the potential at 40 due to ignition current flow of displacement current components in the same direction as created by their respective electric field components F1, F2, F3, F4, F5 and F6, it can be seen that cable 30 as structured acts as a distributed capacitor with a theoretically infinite number of capacitive elements traversing the length of the transposed wire pair.

As an example, since electric field vector F1 will be established in a direction from the positively charged wire 35 to the negatively charged wire 33, electric field vector F2 will also be established in a direction from its positively charged wire to its negatively charged wire, but due to transposition of the wires within the wire segment electric field vector F2 will be in a direction opposite to electric field vector F1. Hence current components will be displaced in opposing directions per segment but in the same direction as their respective electric field vectors. Consequently, although the electric field vectors will change in direction with every transposition segment, and thereby effect electric field cancellation, the displacement currents will pass between the wire pair in similar manner as displacement current transfers between plates of a capacitor in a manner documented by Maxwell's equations. It is well known that ignition current is a complex transient current which a capacitor will readily pass.

Applying the right hand rule of current and magnetic field directions, it can be seen from the diagram that magnetic field vector component H1 will be perpendicular to electric field vector component F1, and that magnetic field vector component H2 will be perpendicular to electric field vector component F2. Since the electric field component F1 is in opposite direction to the electric field component F2, the direction of magnetic field vector component H1 will be opposite to the direction of magnetic field vector component H2 and of equal magnitude as H1, thus cancelling each other and precluding induction of such field into the radio receiver. In similar manner H3 will be cancelled by H4 and H5 will be cancelled by H6. It is pointed out that the magnetic fields were simply illustrated in a single plane whereas in actuality such fields are circumferential to the structure of the transposed wire pair with field components that cancel each other everywhere along the length of cable 30.

The current through resistor 36 will be attenuated by virtue of its resistive value and hence magnetic and electric fields due to resistor current flow will be extremely small and by itself ineffective as a radio interference source. However the principal feature of the cable is the coaction of the capacitive and resistive parameters to limit the voltage stress across the cable, also provides a greater current transfer without any substantial radiation therefrom.

Figure 4:
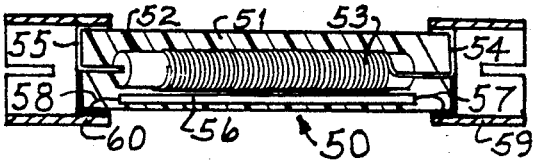
FIG. 4 is a cross section view, partially in perspective, of another version of the distributed parameter capacitance in parallel with a resistive component.
Figure 5:
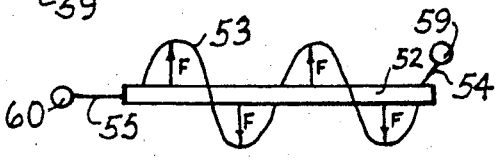
FIG. 5 is a graphical representation of ignition current flow and electric field components by the structure of FIG. 4.

Referring to FIGS. 4 and 5, cable 50 comprises a distributed inductive-capacitive element 52 and 53 and 54 and 55, incorporating a substantially coaxial structure having a central core at 55 which is electrically insulated from winding 53. Winding 53 is terminated at 59 by means of end 54 thereof being in contact with connector 59, and central core 55 is terminated at connector 60 by making contact therewith. Connectors 59 and 60 are crimped to electrical insulation 51 in which the distributed capacity element is embedded. Insulation 51 may be synthetic resin polymer or any other electrical insulation material.

Core 55 may be metallic or a semiconductor material with an electrically insulating material 52 surrounding the metallic or semiconductor core. The end of winding 53, opposite to winding termination at 59, is unconnected. The end of core member 55 opposite to its termination at 60 is also unconnected and is within the confines of core insulation 52.

Resistor 56 is also embedded within insulation 51 and connected in parallel with the distributed capacitor by virtue of ends 57 and 58 thereof being respectively in cooperation with connectors 59 and 60.

It may be seen from the equivalent electric field illustration of FIG. 5, that winding 53 has distributed inductance, a specific value of inductance for each turn of such winding. It may also be appreciated that the distributed capacities thereof are inherent by virtue of its construction and proximities of winding 53 turns to core 55. The distributed capacities will appear between each turn of winding 53 and central core 55.

The distributed capacities formed between each turn of winding 53 and core 55 effect conductive transfer of ignition current via these distributed capacities in similar manner as discussed in conjunction with the structure at 30. However, this structure possesses the ability to effect cancellation of the electric field vector components only during displacement current transfer through the distributed capacities.

Referring to FIGS. 6, 7, 8 and 9 for the structural elements common to each of these configurations, an igniter has R-C components in parallel embedded in ceramic insulators 20 or 520 or in similar ceramic magnet insulators permanently magnetized. Such R-C components are located in the axial or central electrode structure in series with elements of such electrode. The R-C components may be either lumped or distributed parameter types as used in conjunction with the cables, aforesaid. Common to all these igniter structures is an electrically conductive base 10 consisting of sleeve portion 11, flange 12 for fitting a wrench thereover, beveled seat 13 for seating igniter in engine block, and threaded portion 14 for threading the igniter into an aperture in the engine block provided therefor.

Figure 6:
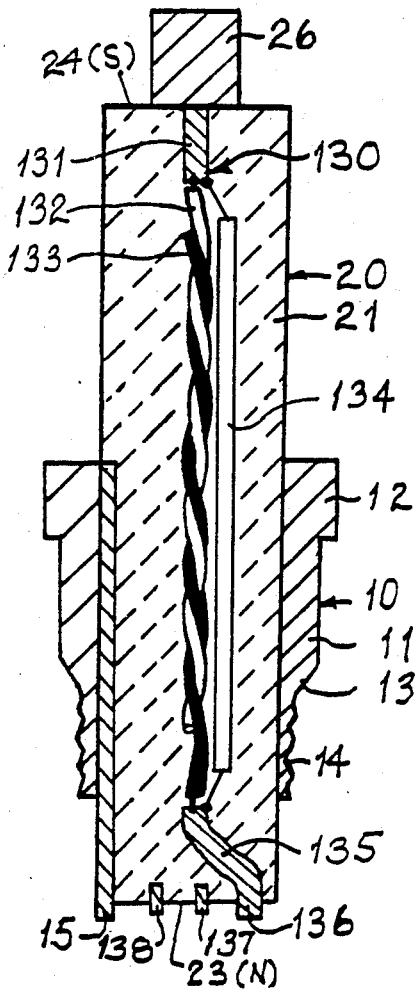
FIG. 6 is a cross section view of an igniter to show a distributed capacitor structure as an integral part of the main electrode.
Figure 7:
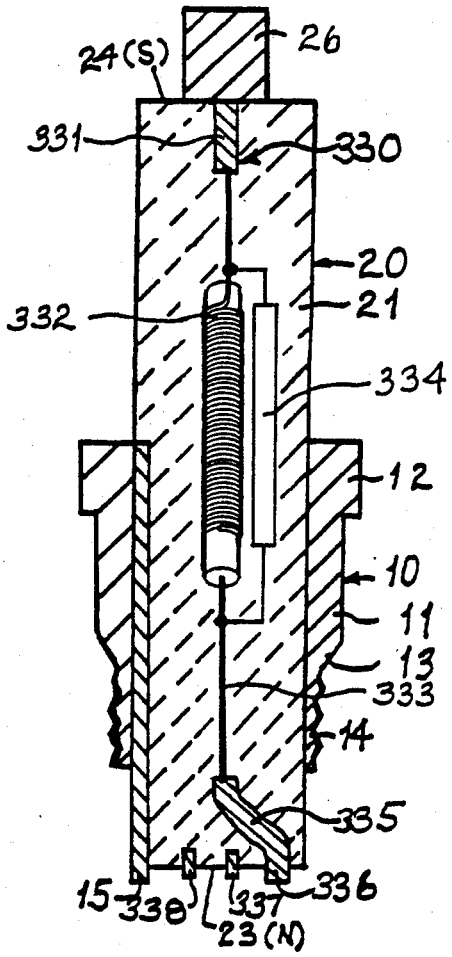
FIG. 7 is a cross section view of an igniter to show another structure that attains distributed capacity integral with the main electrode of the igniter.

FIGS. 6 and 7 have ground electrode 15 which partially fits into a groove in insulator 20 along the length of the insulator thereby extending into the inner periphery of base 10. Thus, electrode 15 may be in cooperation with the conductive material of sleeve 11 or may be an integral part of base 10 by welding same to a portion of the inner peripheral wall of base 10. The material 21 of insulator 20 may be of a conventional ceramic, of micalex, of a barium ferrite compound or of other type ferrites or cermic magnet composition. When material 21 is of a magnetic composition, such insulator may be permanently magnetized north (N) at surface 23 and south (S) at the upper insulator suface 24 where electrical connector cap 26 is connected to portion 131 of axial electrode structure 130 of FIG. 6, or to portion 331 of axial electrode structure 330 of FIG. 7. Magnetically polarizing the insulator will raise the energy level of the arc produced at the base of the igniter between portion 136 of segment 135 of axial electrode structure 130 and elements 137 and 138 embedded in insulator material 21 and ground electrode 15 in FIG. 6 configuration. An arc will appear in the FIG. 7 configuration between portion 336 of segment 335 of axial electrode structure 330 and elements 337 and 338 embedded in insulator material 21 and ground electrode 15.

Referring to FIG. 6, electrode structure 130, encased within insulator material 21, is electrically connected beween member 131 and segment 135. A portion 136 of segment 135 is exposed from the insulator at 23, at the firing end of the igniter. This electrode structure includes a pair of twisted insulated wires 132 (illustrated as a wire with white insulation) and 133 (illustrated as a wire with a black insulation), and shown connected to member 131, and one end of wire 133 is connected to segment 135. The other end of wire 133 is unconnected or open-circuited, and the other end of wire 132 is also unconnected or open-circuited, resulting in a distributed parameter capacitor being connected between member 131 and segment 135. Such twisted pair of wires 132 and 133 also provide AC field cancellation external to the igniter and avoids radio noise induction due to ignition current flow. Resistive element 134, which may be of either the lumped or distributed parameter types, is connected in parallel with distributed capacity element 132–133, and provides a parallel path for ignition current. The combination of resistor and capacitor provide advantages shown in the calculations made in Application Ser. No. 647,166.

The distributed capacity divides the input voltage proportionately along such capacitor's length, so that each unit length of the capacitor is only subjected to a portion of the total ignition input voltage, in contrast with a lumped parameter capacitor which would normally be subjected to the entire voltage. In modern high voltage ignition systems, voltages of about 30 to 40 kilovolts are developed, and a lumped parameter capacitor of low voltage rating within the igniter's insulator would normally break down when subjected to those high ignition voltages.

Referring to FIG. 7, electrode structure 330, encased within insulator material 21, is connected between member 331 and segment 335. A portion 336 is exposed from the insulator at 23 at the firing end of the igniter, and functions in a similar manner as in the case of FIG. 6. This electrode structure is also a distributed capacity arrangement, wherein coil 332 of insulated magnet wire, is tightly wound over an electrical plastic insulated wire 333, and only one end of coil 332 and wire 333 is connected, the other ends of each being open-circuited or non-connected. Thus, one end of coil 332 is connected to member 331, the other end thereof being unconnected or open-circuited. One end of wire 333 is connected to segment 335 and the other end of such wire is within its insulation and open-circuited or not connected to anything. Such distributed capacitor is connected in parallel with resistive element 334 which may be of distributed or lumped parameter type. Both the resistive and capacitive elements are encapsulated within the confines of insulator material 21.

Referring to FIGS. 8 and 9, utilizing lumped parameter capacitor 532 (C) and lumped parameter resitor 533 (R) embedded in insulator material 521 of insulator 520, which is of the same material as insulator material 21, it should be noted that the major problem with lumped parameter capacitors without a resistor in parallel therewith, is the fact that no capacitor of the required value is available that is small enough in physical dimensions so it can be fitted into the igniter's insulator, wherein the capacitor still has the required voltage rating to prevent breakdown under ignition voltage stress. It was experimantally found that such capacitor C at 532 rated at only 3 kilovolts is of small enough dimensions so that it, accompanied by resistor R at 533 in prallel with C, can be included within insulator 520. Resistors ranging between $5\times10^3$ and $2\times10^5$ ohms functioned well in this structure inhibiting breakdown of capacitor C, even in the presence of a 29 kilovolt ignition voltage developed by the secondary winding of the ignition transformer. The result of using a relatively low voltage rated capacitor in the instant circuit was initially rather surprising in terms of what was normally expected. Hence it was decided to subject the resistor-capacitor combination igniter structure to rigorous analytical investigation, discussed in U.S. patent application Ser. No. 647,166, incorporated by reference.

The structural variation of FIGS. 8 and 9 configuration resides in the firing end 525 of insulator 520, which is generally hemispherical or cone shaped, and segment 535 of electrode structure 530 is straight and retained along axis G—G of the igniter.

Accordingly, capacitor C at 532 and resistor R at 533, in parallel connection with each other, are connected between member 531 and segment 535 of the electrode structure, cap 26 being connected to the end of member 531. A flattened portion 523 of firing end 525 in insulator 520 is magnetized magnetic north (N) and an opposite surface 524 at the input end is magnetized magnetic south (S) when material 521 is of the magnetizable type as heretofore described for other similar insulators. The firing end of the insulator at 525 consequently has arc transfer members 537 and 538, and also arc transfer members 537' and 538' embedded partially in the insulating material 521 and partially exposed therefrom.

An arc excursion capability is provided between end 536 of electrode 530 and member 538, between member 538 and member 537, and between member 537 and portion 14 of electrically conductive base 10 in which insulator 520 is retained. Another arc path is provided between end 536 and member 538', between member 538' and member 537', and between member 537' and portion 14 of base 10 in such instance where an AC power source is used in the ignition system to furnish AC power to the primary winding of the ignition transformer as an initial input thereto rather than DC power, and in such case multiple arcs would result. It should be noted that FIG. 8 structure does not show members 537' and 538' in view of its illustrated orientation, However plane H—H provides the cross section view in terms of FIG. 9 to show such arc transfer members.

Referring to FIGS. 6 through 9 structures, it is important to note than there cannot exist any air, vacuum, gas or deficiency of solid insulating material 21 or 521 in proximity of the distributed or lumped parameter capacitance as such would create an undesirable arc internal the igniter insulator and destroy the capacitive effect of the capacitive element by short circuiting such capacitive element and also short circuiting the resistive element. Igniters with gaps in their central electrode structure, although capacitance can be measured across such electrode when there is no ignition current flow therethrough, suffer capacity destruction when arcing across such gap occurs due to current flow in the axial electrode. Hence a capacitive element in the axial electrode must not have any gaps in proximity of its dielectric substance, nor is a gapped central or axial electrode permissible.

Referring to FIGS. 10 and 11, the R-C components of the igniter will effect an igniter current increase and consequently an increased fuel nodule in mass and volume at the firing end of the igniter W, with attendant electrical energy content of the generated electrical arc, thereby increasing the engine efficiency, increasing fuel usage efficiency and decreasing fuel consumption. Einstein's equation for energy, mass and velocity relationships leads to the equation applicable herein:

$$E=m\,v^2,$$

where E is the energy in watt-seconds, m is the mass or volume of the fuel nodule, and v is the velocity of the particles constituting the electric arc.

With these R-C components the fuel nodule will increase by a factor of 4 over the conventional fuel nodule in terms of mass or volume, and considering the current flow increase, more than doubling the arc velocity. The fuel nodule will contain about 9.2 times the energy level as compared to the conventional fuel nodule, constituting a 920% energy increase.

A peak value of ignition voltage $e_2$ of $29\times10^3$ volts is induced in ignition transformer secondary winding L. Voltage $e_2$ is applied to the igniter at U1 and at U2 at initiation of ignition, prior to the time current starts to flow. Hence the question arises as to why capacitor C within the igniter does not break down in view of the peak potential of $e_2$. Bearing in mind that current flow through igniter W is delayed somewhat, the voltage leading the current in a dominating inductive circuit, and that no arc occurs across the gap until current begins to flow, the potential of U2 is the same as the potential at U1, and hence no potential difference is present across capacitor C. Such condition may be stated as:

$$e_{2U1}-e_{2U2}=0,$$

and capacitor C is not subjected to any ignition voltage at that time. When current begins to flow, there will be a relatively low potential difference across capacitor C in any of the RC combinations, so that a capacitor of suitable value and small physical size is realizable within the confines of the igniter's insulator.

Referring to FIGS. 10 and 11, the criteria for determining the relationships of R and C parameter values, may be stated in several ways by the following criteria:

Criteria 1: Any parallel combination of resistor R and capacitor C may be used within the cable having parameters that contribute only first order poles with only real parts in the complex plane of the ignition current expression. First order poles excludes the undesirable condition of multiple order poles thus avoiding high destructive voltages across C.

Criteria 2: Any value of capacitor C may be used within the cable's insulation without a shunt resistor, except a value which resonates the secondary winding inductance of the ignition transformer to the forcing voltage frequency. A resonating capacitor without a shunt resistor will result in a destructive voltage across the capacitor.

Criteria 3: Any parallel combination of resistor R and capacitor C may be used where the parameter relationship of:

$$\left[\frac{R_L}{L}+\frac{1}{RC}\right]^2>4\left[\frac{1}{LC}+\frac{R_L}{LRC}\right]$$

is observed, for the expression of the denominator of ignition current in the complex plane containing R and C parameters. Note that this criteria is substantially the same in effect as Criteria 1, differently stated.

Criteria 4: Any parallel combination of resistor R and capacitor C may be used when their parameter values are such as to limit a voltage thereacross to a peak value of less than 20,000 volts.

I claim:

1. A transmission cable for passing ignition current in an ignition system, said cable having a body comprising electrical insulation, characterized by:

capacitive means, embedded in said electrical insulation, for passing a portion of said ignition current; and resistive means, embedded in said electrical insulation and connected in parallel with said capacitive means, for passing another portion of said ignition current, said capacitive and resistive means having parameter values such as to develop first order poles with only real parts in the complex plane defining said ignition current.

2. The cable as stated in claim 1, wherein said capacitive means is of distributed parameter structure.

3. The cable as stated in claim 1, wherein said resistive means is of distributed parameter structure.

4. The cable as stated in claim 1, wherein capacitive means is of lumped parameter structure.

5. The cable as stated in claim 1, wherein said resistive means is of lumped parameter structure.

6. The cable as stated in claim 1, wherein said capacitive means produces electric and magnetic field components that cancel each other.

7. An igniter for a fuel burning engine, said igniter having an electrical insulator and an electrodestructure substantially at the center of the insulator, characterized by:

a resistor; and a capacitor, connected in parallel with the resistor, said resistor and capacitor being embedded in said insulator and forming part of the electrode stucture.

8. The igniter as stated in claim 7, wherein said capacitor has a distributed parameter configuration.

9. The igniter as stated in claim 7, wherein said capacitor has a lumped parameter configuration.

10. The igniter as stated in claim 7, wherein said resistor has a distributed parameter configuration.

11. The igniter as stated in claim 7, wherein said resistor has a lumped parameter configuration.

12. The igniter as stated in claim 7, having a firing end and a portion of said electrode structure being offset from the center at said firing end.

13. The igniter as stated in claim 7, having a curved firing end.

14. The igniter as stated in claim 7, having a firing end and at least one arc transfer element partially exposed from the insulator at said firing end.

15. The igniter as stated in claim 7, wherein said electrical insulator is of a material having magnetic properties and is permanently magnetized.

16. The igniter as stated in claim 7, wherein said capacitor is a distributed parameter component constituting a transposed pair of electrically insulated wires, the transposed pair having first and second ends, one of the transposed pair being connected at the first end to one side of the resistor and unterminated at the second end, the other of the transposed pair being connected at the second end to the other side of the resistor and unterminated at the first end.

17. The igniter as stated in claim 7, wherein said capacitor is a distributed parameter component having a first end and a second end opposite the first end, and having first and second members, said first member being connected at the first end to one side of the resistor and unterminated at the second end, said second member being connected to the other side of the resistor at the second end and unterminated at the first end.

18. An igniter for a fuel burning engine, said igniter having an electrical insulator and an electrode structure substantially at the center of the insulator, characterized by:

first means, integral with said electrode structure, for providing a first energy component; and second means, in parallel with the first means, for providing a second energy component, said second energy component having a peak value that is substantially time coincident with a peak value of the first energy component.

19. The igniter as stated in claim 18, wherein said insulator is of a material having magnetic properties, said material being magnetized.

20. The igniter as stated in claim 18, wherein said first means comprises a resistor, and said second means comprises a distributed parameter capacitor.

21. An igniter for a fuel burning engine, said igniter having an electrical insulator and providing ignition current, characterized by:

an electrode structure substantially at the center of the insulator; and capacitive reactive means, integral with said electrode structure, said means having parameter values that preclude additional frequencies in said ignition current other than those normally present in the ansence of said means.

22. The igniter as stated in claim 21, wherein said insulator is of a material having magnetic properties, said material being magnetized.

23. The igniter as stated in claim 21, wherein said means comprises:

a distributed parameter capacitor; and a resistor in parallel with said capacitor.

24. The igniter as stated in claim 21, wherein said means comprises:

a capacitor; and a resistor in parallel with said capacitor.

* * * * *